US011373572B2

(12) United States Patent
Lee

(10) Patent No.: US 11,373,572 B2
(45) Date of Patent: Jun. 28, 2022

(54) POWER MANAGEMENT CIRCUIT, METHOD OF GENERATING A PIXEL POWER SUPPLY VOLTAGE, AND DISPLAY DEVICE

(71) Applicant: Samsung Display Co., Ltd., Yongin-Si (KR)

(72) Inventor: Yoon Young Lee, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/202,568

(22) Filed: Mar. 16, 2021

(65) Prior Publication Data

US 2021/0312848 A1 Oct. 7, 2021

(30) Foreign Application Priority Data

Apr. 1, 2020 (KR) ..... 10-2020-0039629

(51) Int. Cl.
*G09G 3/20* (2006.01)

(52) U.S. Cl.
CPC ..... *G09G 3/20* (2013.01); *G09G 2330/028* (2013.01)

(58) Field of Classification Search
CPC ..... G09G 2330/028
See application file for complete search history.

(56) References Cited

U.S. PATENT DOCUMENTS 7,068,024 B1 * 6/2006 Huang ..... G05F 3/262 323/907
8,339,819 B2 * 12/2012 Miyazaki ..... G09G 3/3696 363/59
8,605,074 B2 * 12/2013 Park ..... G09G 3/3233 345/204
8,803,769 B2 8/2014 Park et al.
9,608,522 B2 * 3/2017 Lin ..... H02M 3/158
9,778,672 B1 * 10/2017 Gao ..... G05F 1/575
10,283,050 B2 * 5/2019 Yin ..... G09G 3/3225
11,062,649 B2 * 7/2021 Kim ..... G09G 3/3275
11,069,309 B2 * 7/2021 Sultenfuss ..... G09G 3/3406
(Continued)

FOREIGN PATENT DOCUMENTS

KR 101788218 B1 10/2017
KR 1020190079262 A 7/2019
KR 102029490 B1 10/2019

*Primary Examiner* — Gene W Lee
(74) *Attorney, Agent, or Firm* — Cantor Colburn LLP

(57) ABSTRACT

A power management circuit includes a boost converter which generates a boosted voltage at a boosting node by boosting an input voltage by using a reference boosting voltage, a voltage regulator coupled to the boosting node and an output node, a bypass transistor coupled between the boosting node and the output node, and a regulator control block which compares the input voltage with a reference input voltage. When the input voltage is higher than or equal to the reference input voltage, the regulator control block increases the reference boosting voltage to increase the boosted voltage, enables the voltage regulator to generate a regulated voltage by regulating the increased boosted voltage, turns off the bypass transistor such that the regulated voltage is output as a pixel power supply voltage at the output node, and maintains an enable state of the voltage regulator for a minimum enable time.

20 Claims, 9 Drawing Sheets

(56) References Cited

U.S. PATENT DOCUMENTS

| | | | | |
|---|---|---|---|---|
| 11,145,242 | B2 * | 10/2021 | Liu | H02M 3/1582 |
| 2010/0013445 | A1 * | 1/2010 | Martinussen | H02M 3/07 327/536 |
| 2010/0265241 | A1 * | 10/2010 | Tahata | H02M 3/07 345/212 |
| 2016/0293106 | A1 * | 10/2016 | Seo | G09G 3/20 |
| 2017/0285675 | A1 * | 10/2017 | Gao | G05F 1/575 |

* cited by examiner

POWER MANAGEMENT CIRCUIT, METHOD OF GENERATING A PIXEL POWER SUPPLY VOLTAGE, AND DISPLAY DEVICE

This application claims priority to Korean Patent Application No. 10-2020-0039629, filed on Apr. 1, 2020, and all the benefits accruing therefrom under 35 USC § 119, the content of which in its entirety is herein incorporated by reference.

BACKGROUND

1. Field

Embodiments of the invention relate to a display device, and more particularly to a power management circuit for supplying a pixel power supply voltage to pixels of a display panel, a method of generating the pixel power supply voltage, and a display device including the power management circuit.

2. Description of the Related Art

A display device may include a power management circuit that generates power supply voltages suitable for driving a display panel based on an input voltage, such as a battery voltage or a system voltage. For example, the power management circuit may generate a pixel power supply voltage supplied to pixels of the display panel by performing a boosting operation on the input voltage.

SUMMARY

In a display device where a power management circuit generates a pixel power supply voltage supplied to pixels of a display panel by performing a boosting operation on an input voltage, the pixel power supply voltage generated by the power management circuit may fluctuate if the input voltage fluctuates due to a noise, etc. In particular, in a case where the input voltage has a voltage level higher than a desired voltage level of the pixel power supply voltage, the boosting operation may not be normally performed, and the pixel power supply voltage having the desired voltage level may not be generated.

Embodiments provide a power management circuit capable of generating a pixel power supply voltage having a desired voltage level with respect to a wide range of input voltages.

Embodiments provide a method of generating a pixel power supply voltage having a desired voltage level with respect to a wide range of input voltages.

Embodiments provide a display device including a power management circuit capable of generating a pixel power supply voltage having a desired voltage level with respect to a wide range of input voltages.

According to an embodiment, a power management circuit for supplying a pixel power supply voltage to pixels of a display panel includes a boost converter which generates a boosted voltage at a boosting node by boosting an input voltage by using a reference boosting voltage, a voltage regulator coupled to the boosting node and an output node, a bypass transistor coupled between the boosting node and the output node, and a regulator control block which receives the input voltage, outputs the reference boosting voltage, and controls the voltage regulator and the bypass transistor, where the regulator control block compares the input voltage with a reference input voltage. In such an embodiment, when the input voltage is higher than or equal to the reference input voltage, the regulator control block increases the reference boosting voltage to increase the boosted voltage, enables the voltage regulator to generate a regulated voltage by regulating the increased boosted voltage, turns off the bypass transistor such that the regulated voltage is output as the pixel power supply voltage at the output node, and maintains an enable state of the voltage regulator for a minimum enable time.

In an embodiment, when the input voltage is lower than the reference input voltage, the regulator control block may disable the voltage regulator, and may turn on the bypass transistor such that the boosted voltage is output as the pixel power supply voltage at the output node.

In an embodiment, the regulator control block may generate a regulator enable signal having a first voltage level when the input voltage is lower than the reference input voltage, and the regulator control block may generate the regulator enable signal having a second voltage level when the input voltage is higher than or equal to the reference input voltage.

In an embodiment, the voltage regulator may be disabled in response to the regulator enable signal having the first voltage level, and the voltage regulator may be enabled in response to the regulator enable signal having the second voltage level.

In an embodiment, the bypass transistor may be turned on to connect the boosting node to the output node in response to the regulator enable signal having the first voltage level, and the bypass transistor may be turned off to disconnect the boosting node from the output node in response to the regulator enable signal having the second voltage level.

In an embodiment, the regulator control block may include an input voltage sensing block which senses the input voltage, and compares the input voltage with the reference input voltage, and a timing control block which counts a time period from a time point at which the voltage regulator is enabled. In such an embodiment, when the input voltage is higher than or equal to the reference input voltage, the regulator control block may generate a regulator enable signal having a second voltage level, may maintain the regulator enable signal as the second voltage level until the counted time period becomes the minimum enable time, and may change the regulator enable signal from the second voltage level to a first voltage level when the input voltage becomes lower than the reference input voltage after the counted time period becomes the minimum enable time.

In an embodiment, when the input voltage again becomes higher than or equal to the reference input voltage before the counted time period becomes the minimum enable time, the timing control block may reset the counted time period, and may again count the time period.

In an embodiment, the minimum enable time may correspond to one frame period for the display panel.

In an embodiment, the minimum enable time may be about 16 ms.

In an embodiment, the voltage regulator may be a low-dropout regulator.

In an embodiment, the voltage regulator may include a switch coupled between the boosting node and the output node, a voltage divider coupled to the output node, and which generates a regulator feedback voltage by dividing the regulated voltage, and an amplifier which controls the switch by comparing the regulator feedback voltage with a reference regulator voltage.

In an embodiment, the boost converter may include an inductor which receives the input voltage, a capacitor coupled to the boosting node, a p-type transistor coupled between the inductor and the boosting node, an n-type transistor coupled between the inductor and a ground voltage, a boosting voltage divider coupled to the boosting node, and which generates a boosting feedback voltage by dividing the boosted voltage, an error amplifier which amplifies a difference between the boosting feedback voltage and the reference boosting voltage, a comparator which compares an output signal of the error amplifier with a ramp voltage, and a switch control block which generates a first switching signal and a second switching signal to control the p-type transistor and the n-type transistor based on an output signal of the comparator.

In an embodiment, the power management circuit may further include an inverting buck-boost converter which converts the input voltage into a negative pixel power supply voltage for the pixels, and an additional boost converter which converts the input voltage into an analog power supply voltage.

According to an embodiment, a method of generating a pixel power supply voltage to be supplied to pixels of a display panel includes comparing an input voltage with a reference input voltage, generating a boosted voltage by boosting the input voltage by using a reference boosting voltage when the input voltage is lower than the reference input voltage, outputting the boosted voltage as the pixel power supply voltage when the input voltage is lower than the reference input voltage, increasing the reference boosting voltage when the input voltage is higher than or equal to the reference input voltage, generating an increased boosted voltage by boosting the input voltage by using the increased reference boosting voltage when the input voltage is higher than or equal to the reference input voltage, generating, at a voltage regulator, a regulated voltage by regulating the increased boosted voltage when the input voltage is higher than or equal to the reference input voltage, outputting the regulated voltage as the pixel power supply voltage when the input voltage is higher than or equal to the reference input voltage, and maintaining an enable state of the voltage regulator a minimum enable time when the input voltage is higher than or equal to the reference input voltage.

In an embodiment, the outputting the boosted voltage as the pixel power supply voltage may include disabling the voltage regulator, and turning on a bypass transistor coupled between a boosting node and an output node.

In an embodiment, the outputting the regulated voltage as the pixel power supply voltage may include enabling the voltage regulator, and turning off a bypass transistor coupled between a boosting node and an output node.

In an embodiment, the maintaining the enable state of the voltage regulator for the minimum enable time may include counting a time period from a time point at which the voltage regulator is enabled, and maintaining the enable state of the voltage regulator until the counted time period becomes the minimum enable time.

In an embodiment, the method may further include disabling the voltage regulator when the input voltage becomes lower than the reference input voltage after the counted time period becomes the minimum enable time.

In an embodiment, the method may further include resetting the counted time period when the input voltage again becomes higher than or equal to the reference input voltage before the counted time period becomes the minimum enable time.

According to an embodiment, a display device includes a display panel including pixels, a data driver which provides data signals to the pixels, a scan driver which provides scan signals to the pixels, a controller which controls the data driver and the scan driver, and a power management circuit which supplies a pixel power supply voltage to the pixels. In such an embodiment, the power management circuit includes a boost converter which generates a boosted voltage at a boosting node by boosting an input voltage by using a reference boosting voltage, a voltage regulator coupled to the boosting node and an output node, a bypass transistor coupled between the boosting node and the output node, and a regulator control block which receives the input voltage, outputs the reference boosting voltage, and controls the voltage regulator and the bypass transistor, where the regulator control block compares the input voltage with a reference input voltage. In such an embodiment, when the input voltage is higher than or equal to the reference input voltage, the regulator control block increases the reference boosting voltage to increase the boosted voltage, enables the voltage regulator to generate a regulated voltage by regulating the increased boosted voltage, turns off the bypass transistor such that the regulated voltage is output as the pixel power supply voltage at the output node, and maintains an enable state of the voltage regulator for a minimum enable time.

As described above, in embodiments of a power management circuit, a method of generating a pixel power supply voltage, and a display device according to the invention, when an input voltage is higher than or equal to a reference input voltage, a boosted voltage may be increased, a voltage regulator may be enabled to generate a regulated voltage by regulating the increased boosted voltage, the regulated voltage may be output as a pixel power supply voltage, and an enable state of the voltage regulator may be maintained for a minimum enable time. Accordingly, the pixel power supply voltage having a desired voltage level may be generated with respect to a wide range of input voltages.

BRIEF DESCRIPTION OF THE DRAWINGS

Illustrative, non-limiting embodiments will be more clearly understood from the following detailed description in conjunction with the accompanying drawings.

DETAILED DESCRIPTION OF

Figure 1:
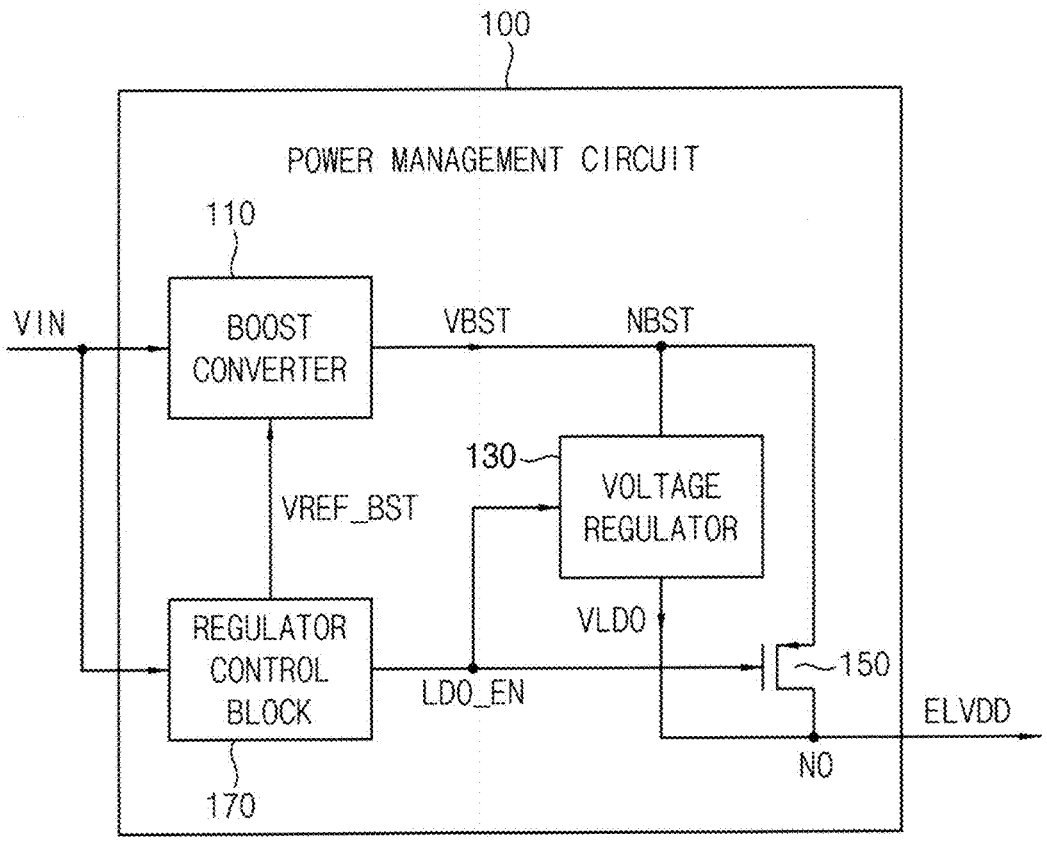
FIG. 1 is a block diagram illustrating a power management circuit according to an embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments of the invention will be described in detail with reference to the accompanying drawings.

FIG. 1 is a block diagram illustrating a power management circuit according to an embodiment.

Referring to FIG. 1, an embodiment of a power management circuit 100 may generate a pixel power supply voltage ELVDD based on an input voltage VIN, and may supply the pixel power supply voltage ELVDD to pixels of a display panel. In an embodiment, the input voltage VIN may be, but not limited to, a battery voltage or a system voltage. In an embodiment, the pixel power supply voltage ELVDD may be, but not limited to, a high power supply voltage supplied to the pixels.

In one embodiment, for example, the input voltage VIN may have, but not limited to, a normal input voltage in a range from about 3.4 volts (V) to about 4.4 V, and the pixel power supply voltage ELVDD may be, but not limited to, about 4.6 V. Thus, in such an embodiment, the power management circuit 100 may generate the pixel power supply voltage ELVDD of about 4.6 V by performing a boosting operation on the input voltage VIN of about 4.4 V. In such an embodiment, the input voltage VIN may fluctuate in a period where a battery is charged, or by a touch noise occurring when a touch screen is touched, and the input voltage VIN may have a voltage level close to or higher than a desired voltage level (e.g., about 4.6V) of the pixel power supply voltage ELVDD. When the input voltage VIN has a voltage level higher than or equal to the desired voltage level of the pixel power supply voltage ELVDD, the boosting operation may not be normally performed in a conventional power management circuit, and the pixel power supply voltage ELVDD having the desired voltage level (e.g., about 4.6 V) may not be generated in the conventional power management circuit.

In an embodiment of the invention, the power management circuit 100 may operate in a regulator bypass mode when the input voltage VIN is lower than a reference input voltage, may operate in a regulator enable mode when the input voltage VIN is higher than or equal to the reference input voltage, and thus may generate the pixel power supply voltage ELVDD having the desired voltage level with respect to a wide range of the input voltages VIN including the input voltage VIN of which the voltage level is higher than the desired voltage level. In an embodiment, the power management circuit 100 may include a boost converter 110, a voltage regulator 130, a bypass transistor 150 and a regulator control block 170 to generate the pixel power supply voltage ELVDD having the desired voltage level with respect to the wide range of the input voltages VIN.

The boost converter 110 may generate a boosted voltage VBST at a boosting node NBST by boosting the input voltage VIN by using a reference boosting voltage VREF_BST. In an embodiment, when the input voltage VIN is about 4.4 V lower than the reference input voltage, the power management circuit 100 may operate in the regulator bypass mode. In the regulator bypass mode, the boost converter 110 may generate the boosted voltage VBST having the desired voltage level, for example, the boosted voltage VBST of about 4.6 V, by performing the boosting operation on the input voltage VIN of about 4.4 V by using the reference boosting voltage VREF_BST of about 1.2 V. In such an embodiment, when the input voltage VIN is about 4.6 V higher than or equal to the reference input voltage, the power management circuit 100 may operate in the regulator enable mode. In the regulator enable mode, the boost converter 110 may receive an increased reference boosting voltage VREF_BST of about 1.25 V that is increased from the reference boosting voltage VREF_BST of about 1.2 V in the regulator bypass mode, and may generate the boosted voltage VBST of about 4.8 V that is increased from the desired voltage level of about 4.6V by performing the boosting operation on the input voltage VIN of about 4.6 V by using the increased reference boosting voltage VREF_BST of about 1.25 V. However, the increased boosted voltage VBST generated by the boost converter 110 in the regulator enable mode is not limited to about 4.8 V. In one embodiment, for example, the increased boosted voltage VBST in the regulator enable mode may be higher than the input voltage VIN by more than an operating voltage margin of the boost converter 110 in the regulator enable mode. Thus, even when the input voltage VIN has a voltage level higher than the normal input voltage range, for example, in the period where the battery is charged or due to the touch noise, the boost converter 110 may generate the increased boosted voltage VBST higher than the input voltage VIN by more than the operating voltage margin, and thus may normally perform the boosting operation.

The voltage regulator 130 may be coupled to the boosting node NBST and an output node NO. In an embodiment, the voltage regulator 130 may be, but not limited to, a low-dropout ("LDO") regulator. The voltage regulator 130 may be disabled in the regulator bypass mode, and may be enabled in the regulator enable mode. In an embodiment, in the regulator bypass mode, the voltage regulator 130 may receive a regulator enable signal LDO_EN having a first voltage level (e.g., a low level), and may be disabled in response to the regulator enable signal LDO_EN having the first voltage level. Further, in the regulator enable mode, the voltage regulator 130 may receive the regulator enable signal LDO_EN having a second voltage level (e.g., a high level), and may be enabled in response to the regulator enable signal LDO_EN having the second voltage level. Thus, in the regulator bypass mode, the voltage regulator 130 may be disabled in response to the regulator enable signal LDO_EN having the first voltage level, thereby reducing power consumption of the voltage regulator 130 and the power management circuit 100. In such an embodiment, in the regulator enable mode, the voltage regulator 130 may be enabled in response to the regulator enable signal LDO_EN having the second voltage level, and may receive the increased boosted voltage VBST of about 4.8 V from the boost converter 110. The voltage regulator 130 in an enable state may generate a regulated voltage VLDO having the desired voltage level for the pixel power supply voltage ELVDD, for example the regulated voltage VLDO of about 4.6 V by regulating the increased boosted voltage VBST of about 4.8 V.

The bypass transistor 150 may be coupled between the boosting node NBST and the output node NO. In an embodiment, as illustrated in FIG. 1, the bypass transistor 150 may be connected in parallel with the voltage regulator 130 between the boosting node NBST and the output node NO. In an embodiment, as illustrated in FIG. 1, the bypass transistor 150 may be implemented with, but not limited to, a p-type transistor. In one embodiment, for example, the bypass transistor 150 may include a gate for receiving the regulator enable signal LDO_EN, a source coupled to the boosting node NBST, and a drain coupled to the output node NO. The bypass transistor 150 may connect the boosting node NBST to the output node NO in the regulator bypass mode, and may disconnect the boosting node NBST from the output node NO in the regulator enable mode. In an embodiment, in the regulator bypass mode, the bypass transistor 150 may receive the regulator enable signal LDO_EN having the first voltage level (e.g., the low level), and may be turned on to connect the boosting node NBST to the output node NO in response to the regulator enable signal LDO_EN having the first voltage level. In such an embodiment, in the regulator enable mode, the bypass transistor 150 may receive the regulator enable signal LDO_EN having the second voltage level (e.g., the high level), and may be turned off to disconnect the boosting node NBST from the output node NO in response to the regulator enable signal LDO_EN having the second voltage level. Accordingly, in the regulator bypass mode, the boosting node NBST may be connected to the output node NO, and thus the boosted voltage VBST having the desired voltage level, for example, the boosted voltage VBST of about 4.6 V, may be output as the pixel power supply voltage ELVDD at the output node NO. In such an embodiment, in the regulator enable mode, the boosting node NBST may be disconnected from the output node NO, and thus the regulated voltage VLDO having the desired voltage level, for example, the regulated voltage VLDO of about 4.6 V, may be output as the pixel power supply voltage ELVDD at the output node NO.

The regulator control block 170 may sense the input voltage VIN, and may control the power management circuit 100 to selectively operate in the regulator bypass mode or in the regulator enable mode based on a voltage level of the input voltage VIN. In an embodiment, the regulator control block 170 may compare the input voltage VIN with the reference input voltage, may control the power management circuit 100 to operate in the regulator bypass mode when the input voltage VIN is lower than the reference input voltage, and may control the power management circuit 100 to operate in the regulator enable mode when the input voltage VIN is higher than or equal to the reference input voltage. In an embodiment, the reference input voltage may be determined by subtracting the operating voltage margin of the boost converter 110 from the desired voltage level for the pixel power supply voltage ELVDD, and thus the boosting operation of the boost converter 110 may be normally performed. In one embodiment, for example, where the desired voltage level for the pixel power supply voltage ELVDD is about 4.6 V, the reference input voltage may be determined as, but not limited to, about 4.5 V.

In an embodiment, when the input voltage VIN is lower than the reference input voltage, the regulator control block 170 may provide the reference boosting voltage VREF_BST having a normal voltage level, for example, the reference boosting voltage VREF_BST of about 1.2 V to the boost converter 110, and may provide the regulator enable signal LDO_EN having the first voltage level (e.g., the low level) to the voltage regulator 130 and the bypass transistor 150 to control the power management circuit 100 to operate in the regulator bypass mode. The boost converter 110 may generate the boosted voltage VBST having the desired voltage level, for example, the boosted voltage VBST of about 4.6 V, at the boosting node NBST by boosting the input voltage VIN by using the reference boosting voltage VREF_BST of about 1.2 V. In such an embodiment, the voltage regulator 130 may be disabled in response to the regulator enable signal LDO_EN having the first voltage level, and the bypass transistor 150 may connect the boosting node NBST to the output node NO in response to the regulator enable signal LDO_EN having the first voltage level. Accordingly, the boosted voltage VBST having the desired voltage level may be output as the pixel power supply voltage ELVDD at the output node NO in the regulator bypass mode.

In such an embodiment, when the input voltage VIN is higher than or equal to the reference input voltage, the regulator control block 170 may provide the reference boosting voltage VREF_BST of, for example, about 1.25V that is increased from the normal voltage level of about 1.2V, to the boost converter 110, and may provide the regulator enable signal LDO_EN having the second voltage level (e.g., the high level) to the voltage regulator 130 and the bypass transistor 150 to control the power management circuit 100 to operate in the regulator enable mode. The boost converter 110 may generate the boosted voltage VBST of, for example, about 4.8V that is increased from the desired voltage level of about 4.6V at the boosting node NBST by boosting the input voltage VIN by using the increased reference boosting voltage VREF_BST. In such an embodiment, the voltage regulator 130 may be enabled in response to the regulator enable signal LDO_EN having the second voltage level, and may generate the regulated voltage VLDO having the desired voltage level for the pixel power supply voltage ELVDD, for example, the regulated voltage VLDO of about 4.6 V, by regulating the increased boosted voltage VBST of about 4.8V. The bypass transistor 150 may disconnect the boosting node NBST from the output node NO in response to the regulator enable signal LDO_EN having the second voltage level. Accordingly, the regulated voltage VLDO having the desired voltage level may be output as the pixel power supply voltage ELVDD at the output node NO in the regulator enable mode.

In an embodiment, once the power management circuit 100 enters the regulator enable mode, the regulator control block 170 may maintain the regulator enable mode for at least a minimum enable time. That is, the regulator control block 170 may maintain the enable state of the voltage regulator 130 for at least the minimum enable time. In an embodiment, the minimum enable time may correspond to one frame period for the display panel. In one embodiment, for example, the minimum enable time may be, but not limited to, about 16 microseconds (ms). If the input voltage VIN fluctuates, and an operating mode of the power management circuit 100 transitions between the regulator bypass mode and the regulator enable mode at an excessively short time interval, the pixel power supply voltage ELVDD output from the power management circuit 100 may have a ripple due to such mode transition. However, in an embodiment of the power management circuit 100, the regulator control block 170 may maintain the regulator enable mode or the enable state of the voltage regulator 130 for at least the minimum enable time (e.g., one frame period), thereby effectively preventing the ripple of the pixel power supply voltage ELVDD caused by the mode transition. In such an embodiment, if the regulator enable mode is maintained for an excessively long time, the power consumption of the power management circuit 100 may be excessively increased. However, in an embodiment of the power management circuit 100, the regulator control block 170 may maintain the regulator enable mode or the enable state of the voltage regulator 130 for the minimum enable time corresponding to the one frame period, thereby effectively preventing the excessive increase of the power consumption of the power management circuit 100.

As described above, in an embodiment of the power management circuit 100, when the input voltage VIN is higher than or equal to the reference input voltage, the boosted voltage VBST may be increased, the voltage regulator 130 may be enabled to generate the regulated voltage VLDO by regulating the increased boosted voltage VBST, the regulated voltage VLDO may be output as the pixel power supply voltage ELVDD, and the enable state of the voltage regulator 130 may be maintained for the minimum enable time. Accordingly, the pixel power supply voltage ELVDD having the desired voltage level may be generated with respect to the wide range of the input voltages VIN.

Figure 2:
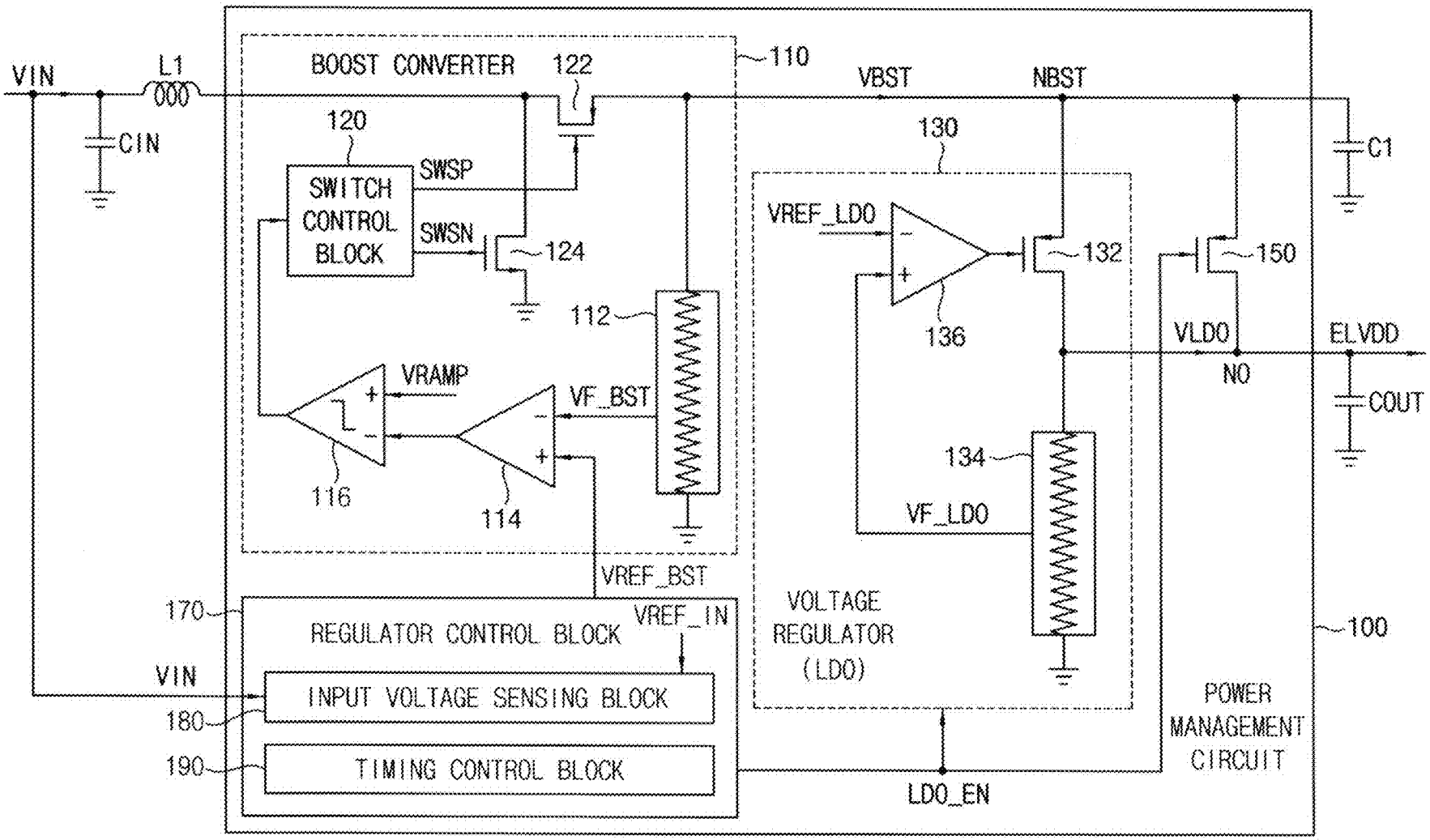
FIG. 2 is a schematic circuit diagram illustrating a power management circuit according to an embodiment.

FIG. 2 is a schematic circuit diagram illustrating a power management circuit according to an embodiment.

Referring to FIG. 2, an embodiment of a power management circuit 100 for supplying a pixel power supply voltage ELVDD to pixels of a display panel may include a boost converter 110, a voltage regulator 130, a bypass transistor 150 and a regulator control block 170. In an embodiment, the power management circuit 100 may further include an input capacitor CIN connected to an input node, and an output capacitor COUT connected to an output node NO. In an embodiment, the power management circuit 100 may be implemented with a power management integrated circuit ("PMIC").

The boost converter 110 may include an inductor L1 that receives an input voltage VIN, a capacitor C1 coupled to a boosting node NBST, a p-type transistor 122 coupled between the inductor L1 and the boosting node NBST, an n-type transistor 124 coupled between the inductor L1 and a ground voltage, a boosting voltage divider 112 coupled to the boosting node NBST and configured to generate a boosting feedback voltage VF_BST by dividing a boosted voltage VBST, an error amplifier 114 configured to amplify a difference between the boosting feedback voltage VF_BST and a reference boosting voltage VREF_BST, a comparator 116 configured to compare an output signal of the error amplifier 114 with a ramp voltage VRAMP, and a switch control block 120 configured to generate a first switching signal SWSP and a second switching signal SWSN to control the p-type transistor 122 and the n-type transistor 124 based on an output signal of the comparator 116. The boost converter 110 having such a configuration may control the p-type and n-type transistors 122 and 124 to increase the boosted voltage VBST when the boosting feedback voltage VF_BST is lower than the reference boosting voltage VREF_BST, may control the p-type and n-type transistors 122 and 124 to decrease the boosted voltage VBST when the boosting feedback voltage VF_BST is higher than the reference boosting voltage VREF_BST, and thus may generate the boosted voltage VBST having a voltage level corresponding to the reference boosting voltage VREF_BST. In such an embodiment, when the boost converter 110 receives an increased reference boosting voltage VREF_BST from the regulator control block 170, the boost converter 110 may generate an increased boosted voltage VBST by using the increased reference boosting voltage VREF_BST. Although FIG. 2 illustrates a configuration of an embodiment of the boost converter 110, the configuration of embodiments of the boost converter 110 is not limited to that shown in FIG. 2. Further, in an embodiment, as illustrated in FIG. 2, a portion of passive elements of the power management circuit 100, such as the input capacitor CIN, the output capacitor COUT, the inductor L1 and the capacitor C1, may be located outside the power management integrated circuit, but locations of the passive elements are not limited thereto.

The voltage regulator 130 may include a switch 132 coupled between the boosting node NBST and the output node NO, a voltage divider 134 coupled to the output node NO and configured to generate a regulator feedback voltage VF_LDO by dividing a regulated voltage VLDO, and an amplifier 136 configured to control the switch 132 by comparing the regulator feedback voltage VF_LDO with a reference regulator voltage VREF_LDO. In an embodiment, the switch 132 of the voltage regulator 130 may include a gate for receiving an output signal of the amplifier 136, a source coupled to the boosting node NBST, and a drain coupled to the output node NO. The voltage regulator 130 having such a configuration may increase the regulated voltage VLDO by turning on the switch 132 when the regulator feedback voltage VF_LDO is lower than the reference regulator voltage VREF_LDO, may decrease the regulated voltage VLDO by turning off the switch 132 when the regulator feedback voltage VF_LDO is higher than the reference regulator voltage VREF_LDO, and thus may generate the regulated voltage VLDO having a desired voltage level. FIG. 2 illustrates a configuration of one embodiment of the voltage regulator 130, the configuration of the voltage regulator 130 according to embodiments is not limited to that shown in FIG. 2.

The bypass transistor 150 may be implemented with, but not limited to, a p-type transistor. In an embodiment, the bypass transistor 150 may include a gate for receiving a regulator enable signal LDO_EN, a source coupled to the boosting node NBST, and a drain coupled to the output node NO.

The regulator control block 170 may include an input voltage sensing block 180 configured to sense the input voltage VIN and to compare the input voltage VIN with a reference input voltage VREF_IN, and a timing control block 190 configured to count a time period from a time point at which the voltage regulator 130 is enabled. Each of the regulator control block 170, the input voltage sensing block 180 and the timing control block 190 may be a circuit block. When the input voltage sensing block 180 determines that the input voltage VIN is higher than or equal to the reference input voltage VREF_IN, the regulator control block 170 may generate the regulator enable signal LDO_EN having a second voltage level (e.g., a high level). The boost converter 110 may generate the increased boosted voltage VBST by using the increased reference boosting voltage VREF_BST. In such an embodiment, the voltage regulator 130 may be enabled in response to the regulator enable signal LDO_EN having the second voltage level, and may generate the regulated voltage VLDO having the desired voltage level for the pixel power supply voltage ELVDD by regulating the increased boosted voltage VBST. The bypass transistor 150 may disconnect the boosting node NBST from the output node NO in response to the regulator enable signal LDO_EN having the second voltage level. Accordingly, the regulated voltage VLDO having the desired voltage level may be output as the pixel power supply voltage ELVDD at the output node NO.

In an embodiment, the timing control block 190 may count the time period from the time point at which the voltage regulator 130 is enabled, and the regulator control block 170 may maintain the regulator enable signal LDO_EN as the second voltage level until the time period counted by the timing control block 190 becomes a minimum enable time. Accordingly, an enable state of the voltage regulator 130 may be maintained for at least the minimum enable time (e.g., one frame period), and thus a ripple of the pixel power supply voltage ELVDD caused by a mode transition may be effectively prevented. In such an embodiment, when the input voltage VIN becomes lower than the reference input voltage VREF_IN after the time period counted by the timing control block 190 becomes the minimum enable time, the regulator control block 170 may change the regulator enable signal LDO_EN from the second voltage level to a first voltage level.

In an embodiment, before the time period counted by the timing control block 190 becomes the minimum enable time, when the input voltage VIN again becomes higher than or equal to the reference input voltage VREF_IN after becoming lower than the reference input voltage VREF_IN, the timing control block 190 may reset the counted time period, and may again count the time period from a time point at which the input voltage VIN again becomes higher than or equal to the reference input voltage VREF_IN. Accordingly, the mode transition with an excessively short time interval caused by fluctuations of the input voltage VIN may be effectively prevented.

Figure 3:
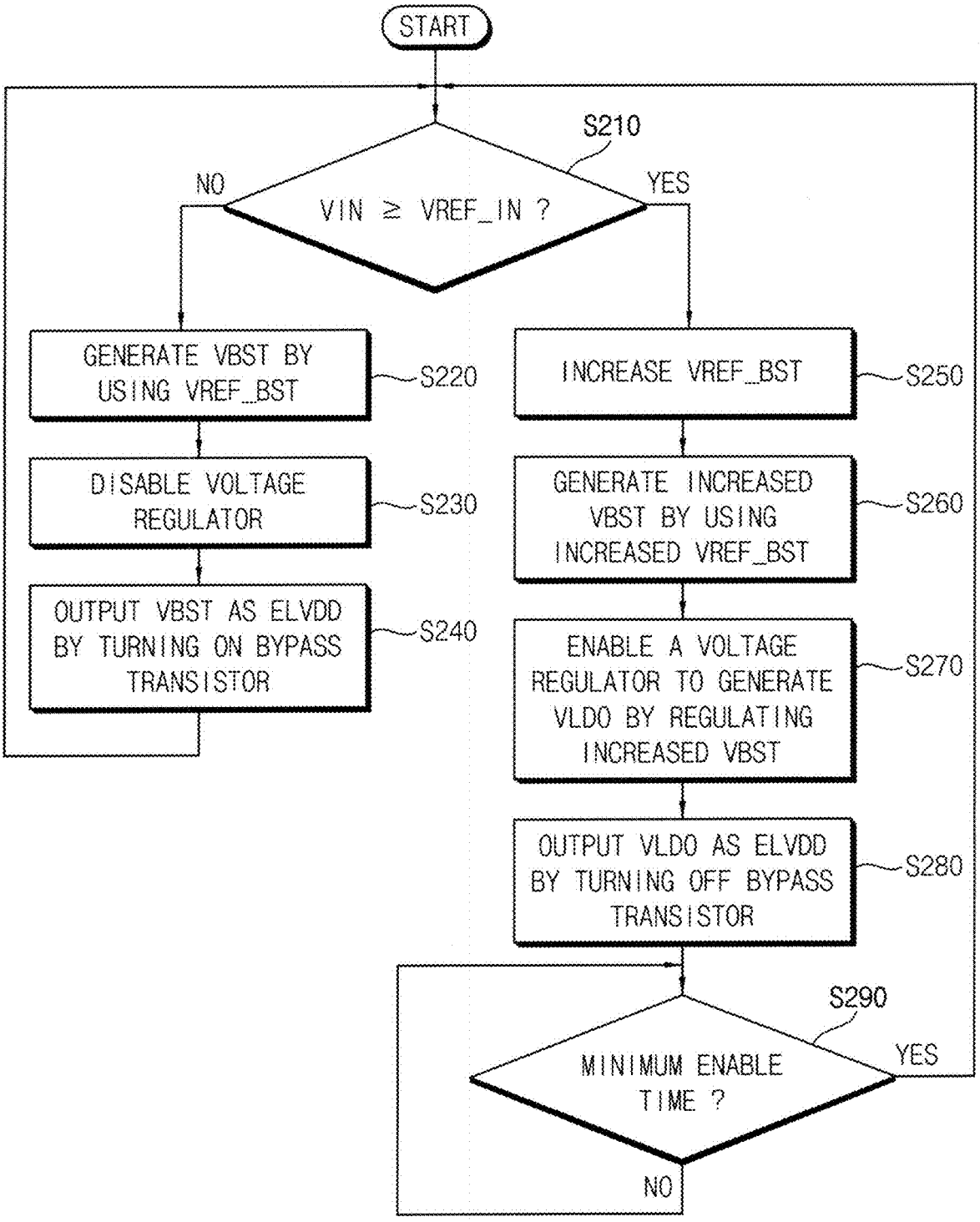
FIG. 3 is a flowchart illustrating a method of generating a pixel power supply voltage according to an embodiment.
Figure 4:
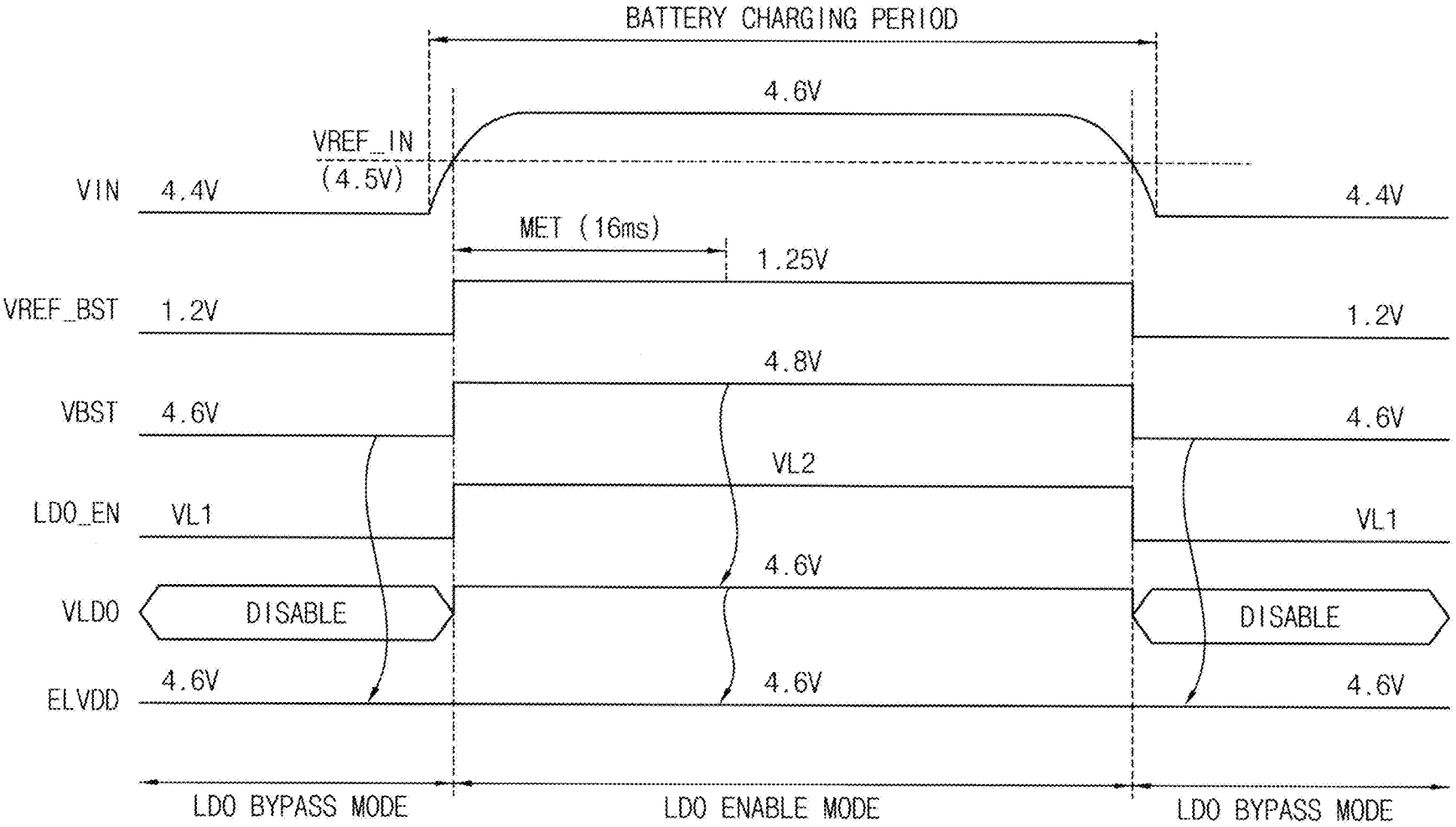
FIG. 4 is a signal timing diagram showing an operation of an embodiment of a power management circuit in a case where an input voltage fluctuates in a battery charging period.
Figure 5:
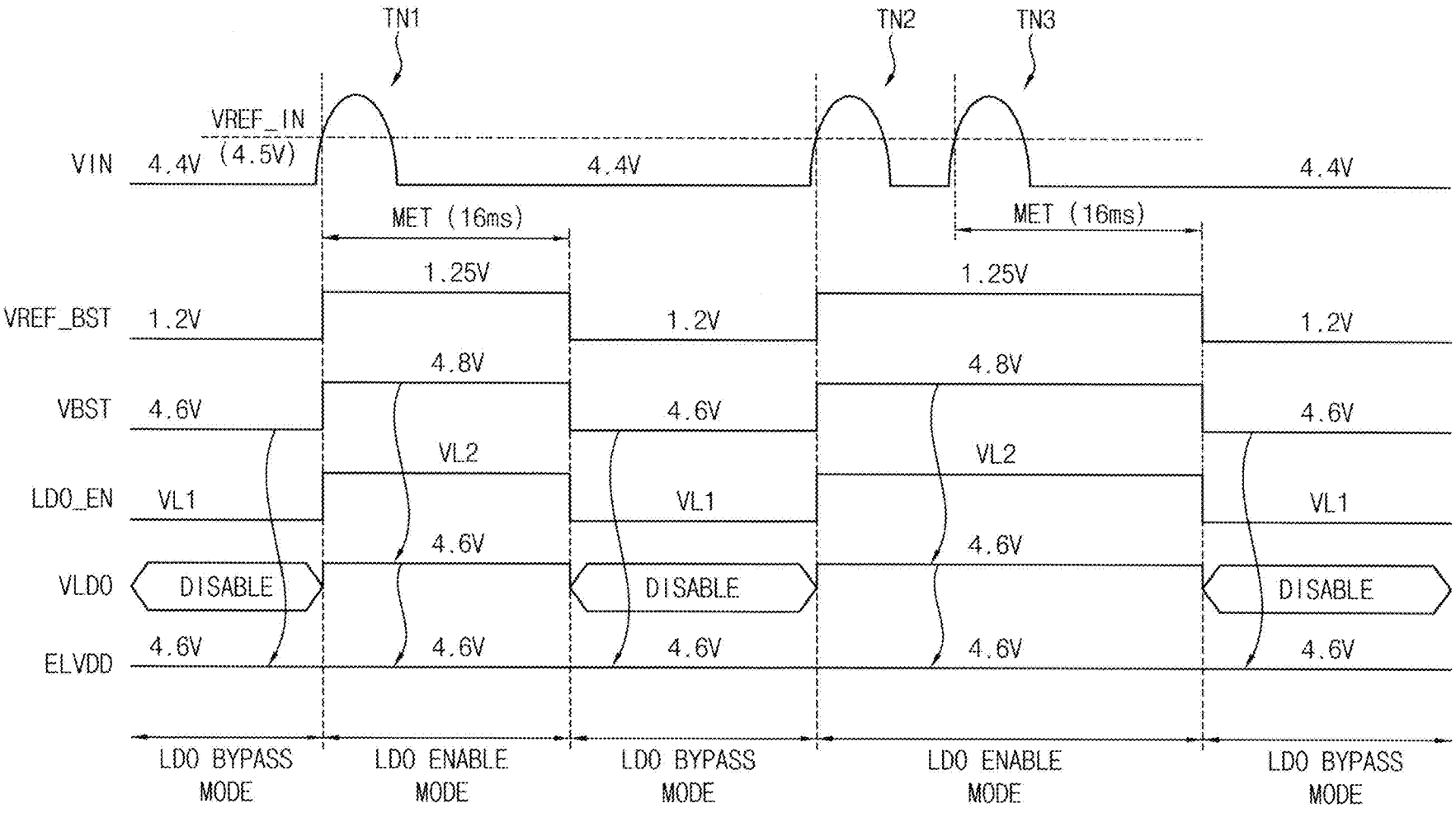
FIG. 5 is a signal timing diagram showing an operation of an embodiment of a power management circuit in a case where an input voltage fluctuates due to a touch noise.
Figure 6A:
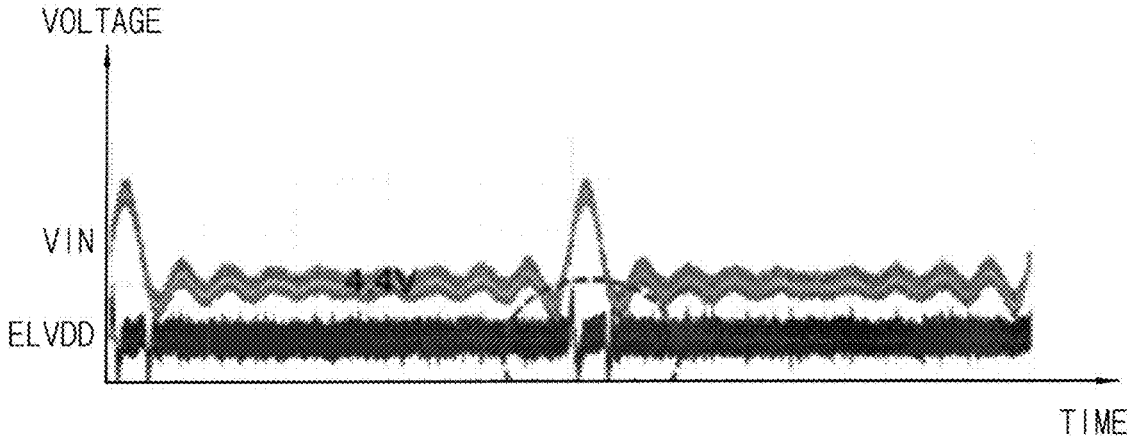
FIG. 6A is a diagram illustrating an input voltage and a pixel power supply voltage in a conventional power management circuit.
Figure 6B:
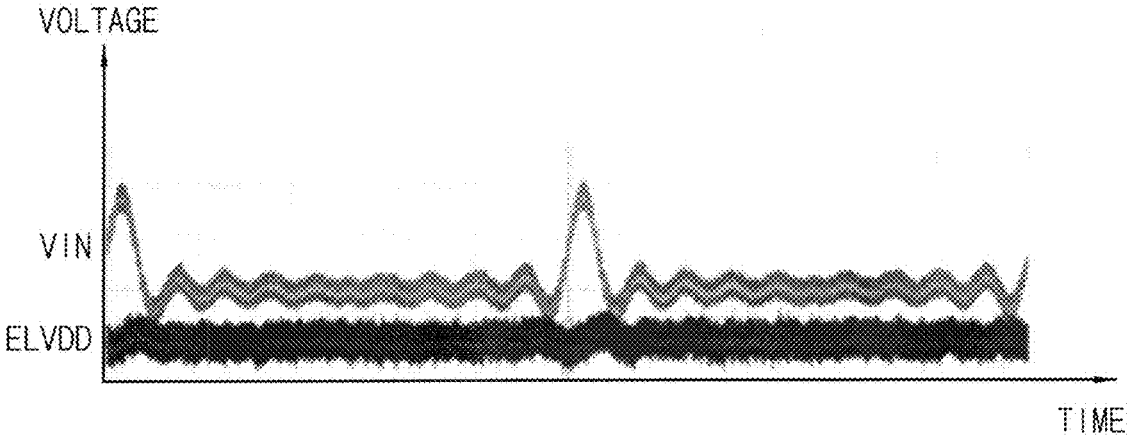
FIG. 6B is a diagram illustrating an input voltage and a pixel power supply voltage in a power management circuit according to an embodiment.

FIG. 3 is a flowchart illustrating a method of generating a pixel power supply voltage according to an embodiment, FIG. 4 is a timing diagram showing an operation of an embodiment of a power management circuit in a case where an input voltage fluctuates in a battery charging period, FIG. 5 is a signal timing diagram showing an operation of an embodiment of a power management circuit in a case where an input voltage fluctuates due to a touch noise, FIG. 6A is a diagram illustrating an input voltage and a pixel power supply voltage in a conventional power management circuit, and FIG. 6B is a diagram illustrating an input voltage and a pixel power supply voltage in a power management circuit according to an embodiment.

Referring to FIGS. 1 through 3, in an embodiment of a method of generating a pixel power supply voltage ELVDD supplied to pixels of a display panel, a regulator control block 170 may compare an input voltage VIN with a reference input voltage VREF_IN (S210). In an embodiment, the reference input voltage VREF_IN may be determined by subtracting an operating voltage margin for a boosting operation by a boost converter 110 from a desired voltage level for the pixel power supply voltage ELVDD. In one embodiment, for example, where the desired voltage level for the pixel power supply voltage ELVDD is about 4.6 V, the reference input voltage VREF_IN may be determined as, but not limited to, about 4.5 V.

In such an embodiment, when the input voltage VIN is lower than the reference input voltage VREF_IN (S210: NO), the boost converter 110 may generate a boosted voltage VBST by boosting the input voltage VIN by using a reference boosting voltage VREF_BST (S220). In one embodiment, for example, the boost converter 110 may generate the boosted voltage VBST of about 4.6 V by boosting the input voltage VIN of about 4.4 V by using the reference boosting voltage VREF_BST of about 1.2 V.

A power management circuit 100 may output the boosted voltage VBST of about 4.6 V as the pixel power supply voltage ELVDD (S230 and S240). In an embodiment, the regulator control block 170 may generate a regulator enable signal LDO_EN having a first voltage level (e.g., a low level), and a voltage regulator 130 may be disabled in response to the regulator enable signal LDO_EN having the first voltage level (S230). In such an embodiment, a bypass transistor 150 may be turned on to connect a boosting node NBST to an output node NO in response to the regulator enable signal LDO_EN having the first voltage level, and the boosted voltage VBST may be output as the pixel power supply voltage ELVDD at the output node NO (S240).

In such an embodiment, when the input voltage VIN is higher than or equal to the reference input voltage VREF_IN (S210: YES), the regulator control block 170 may increase the reference boosting voltage VREF_BST (S250), and the boost converter 110 may generate an increased boosted voltage VBST by boosting the input voltage VIN by using the increased reference boosting voltage VREF_BST (S260). In one embodiment, for example, the boost converter 110 may generate the boosted voltage VBST that is increased from about 4.6 V to about 4.8 V by boosting the input voltage VIN by using the reference boosting voltage VREF_BST that is increased from about 1.2 V to about 1.25 V.

In an embodiment, the regulator control block 170 may generate the regulator enable signal LDO_EN having a second voltage level (e.g., a high level), and the voltage regulator 130 may be enabled in response to the regulator enable signal LDO_EN having the second voltage level (S270). The voltage regulator 130 in an enable state may generate a regulated voltage VLDO of about 4.6 V by regulating the increased boosted voltage VBST of about 4.8 V. In such an embodiment, the bypass transistor 150 may be turned off to disconnect the boosting node NBST from the output node NO in response to the regulator enable signal LDO_EN having the second voltage level, and the regulated voltage VLDO may be output as the pixel power supply voltage ELVDD at the output node NO (S280).

The second voltage level of the regulator enable signal LDO_EN, or the enable state of the voltage regulator 130 may be maintained for a minimum enable time (S290). In an embodiment, a timing control block 190 may count a time period from a time point at which the voltage regulator 130 is enabled, and, until the time period counted by the timing control block 190 becomes the minimum enable time (S290: NO), the enable state of the voltage regulator 130 may be maintained. In such an embodiment, after the time period counted by the timing control block 190 becomes the minimum enable time (S290: YES), when the input voltage VIN becomes lower than the reference input voltage VREF_IN (S210: NO), the voltage regulator 130 may be disabled (S230). In an embodiment, before the time period counted by the timing control block 190 becomes the minimum enable time, when the input voltage VIN again becomes higher than or equal to the reference input voltage VREF_IN after becoming lower than the reference input voltage VREF_IN, the time period counted by the timing control block 190 may be reset, and the timing control block 190 may again count the time period from a time point at which the input voltage VIN again becomes higher than or equal to the reference input voltage VREF_IN.

In one embodiment, for example, as illustrated in FIG. 4, in a battery charging period in which a battery of an electronic device including the power management circuit 100 is charged by an adapter or the like, the input voltage VIN may be increased from about 4.4 V to about 4.6 V. When the input voltage VIN becomes higher than or equal to the reference input voltage VREF_IN of about 4.5 V, the regulator control block 170 may change an operating mode of the power management circuit 100 from a regulator bypass mode to a regulator enable mode. In one embodiment, for example, the regulator control block 170 may increase the reference boosting voltage VREF_BST from about 1.2 V to about 1.25 V, and the boost converter 110 may generate the boosted voltage VBST that is increased from about 4.6 V to about 4.8 V by using the increased reference boosting voltage VREF_BST. In such an embodiment, the regulator control block 170 may change the regulator enable signal LDO_EN from the first voltage level VL1 to the second voltage level VL2. The voltage regulator 130 may be enabled in response to the regulator enable signal LDO_EN having the second voltage level VL2, and may generate the regulated voltage VLDO of about 4.6 V by regulating the increased boosted voltage VBST of about 4.8 V. In such an embodiment, the bypass transistor 150 may be turned off in response to the regulator enable signal LDO_EN having the second voltage level VL2, and the regulated voltage VLDO of about 4.6 V may be output as the pixel power supply voltage ELVDD at the output node NO. The second voltage level VL2 of the regulator enable signal LDO_EN, or the enable state of the voltage regulator 130 may be maintained for the minimum enable time MET of about 16 ms. After the minimum enable time MET, when the input voltage VIN becomes lower than the reference input voltage VREF_IN of about 4.5 V, the regulator control block 170 may change the operating mode of the power management circuit 100 from the regulator enable mode to the regulator bypass mode.

In one embodiment, for example as illustrated in FIG. 5, when a touch screen of an electronic device including the power management circuit 100 is touched, the input voltage VIN may fluctuate due to touch noises TN1, TN2 and TN3. When the input voltage VIN becomes higher than or equal to the reference input voltage VREF_IN of about 4.5 V by a first touch noise TN1, the regulator control block 170 may change the operating mode of the power management circuit 100 from the regulator bypass mode to the regulator enable mode. In one embodiment, for example, in the regulator enable mode, the reference boosting voltage VREF_BST may be increased from about 1.2 V to about 1.25 V, the boosted voltage VBST may be increased from about 4.6 V to about 4.8 V, the regulator enable signal LDO_EN may be changed from the first voltage level VL1 to the second voltage level VL2, the regulated voltage VLDO of about 4.6 V may be generated by regulating the increased boosted voltage VBST of about 4.8 V, and the regulated voltage VLDO of about 4.6 V may be output as the pixel power supply voltage ELVDD. Although the input voltage VIN becomes lower than the reference input voltage VREF_IN of about 4.5 V, the regulator enable mode, or the enable state of the voltage regulator 130 may be maintained for the minimum enable time MET of about 16 ms. After the minimum enable time MET, the regulator control block 170 may change the operating mode of the power management circuit 100 from the regulator enable mode to the regulator bypass mode. When the input voltage VIN becomes higher than or equal to the reference input voltage VREF_IN of about 4.5 V by a second touch noise TN2, the regulator control block 170 may change the operating mode of the power management circuit 100 from the regulator bypass mode to the regulator enable mode. Within the minimum enable time MET, the input voltage VIN may become lower than the reference input voltage VREF_IN of about 4.5 V, and then may again become higher than or equal to the reference input voltage VREF_IN of about 4.5 V by a third touch noise TN3. In this case, the timing control block 190 may reset the counted time period, and may restart a counting operation. When the time period counted by the restarted counting operation becomes the minimum enable time MET of about 16 ms, and the input voltage VIN becomes lower than the reference input voltage VREF_IN of about 4.5 V, the regulator control block 170 may change the operating mode of the power management circuit 100 from the regulator enable mode to the regulator bypass mode.

FIG. 6A illustrates the input voltage VIN and the pixel power supply voltage ELVDD in a conventional power management circuit, and FIG. 6B illustrates the input voltage VIN and the pixel power supply voltage ELVDD in the power management circuit 100 according to an embodiment.

As illustrated in FIG. 6A, when the input voltage VIN fluctuates, the pixel power supply voltage ELVDD generated by the conventional power management circuit also may fluctuate. However, in an embodiment of the power management circuit 100 according to the invention, when the input voltage VIN is higher than or equal to the reference input voltage VREF_IN, the boosted voltage VBST may be increased, the voltage regulator 130 may be enabled to generate the regulated voltage VLDO by regulating the increased boosted voltage VBST, the regulated voltage VLDO may be output as the pixel power supply voltage ELVDD, and the enable state of the voltage regulator 130 may be maintained for the minimum enable time MET. Accordingly, as illustrated in FIG. 6B, even when the input voltage VIN fluctuates, the pixel power supply voltage ELVDD generated by an embodiment of the power management circuit 100 may have a substantially or relatively constant voltage level.

Figure 7:
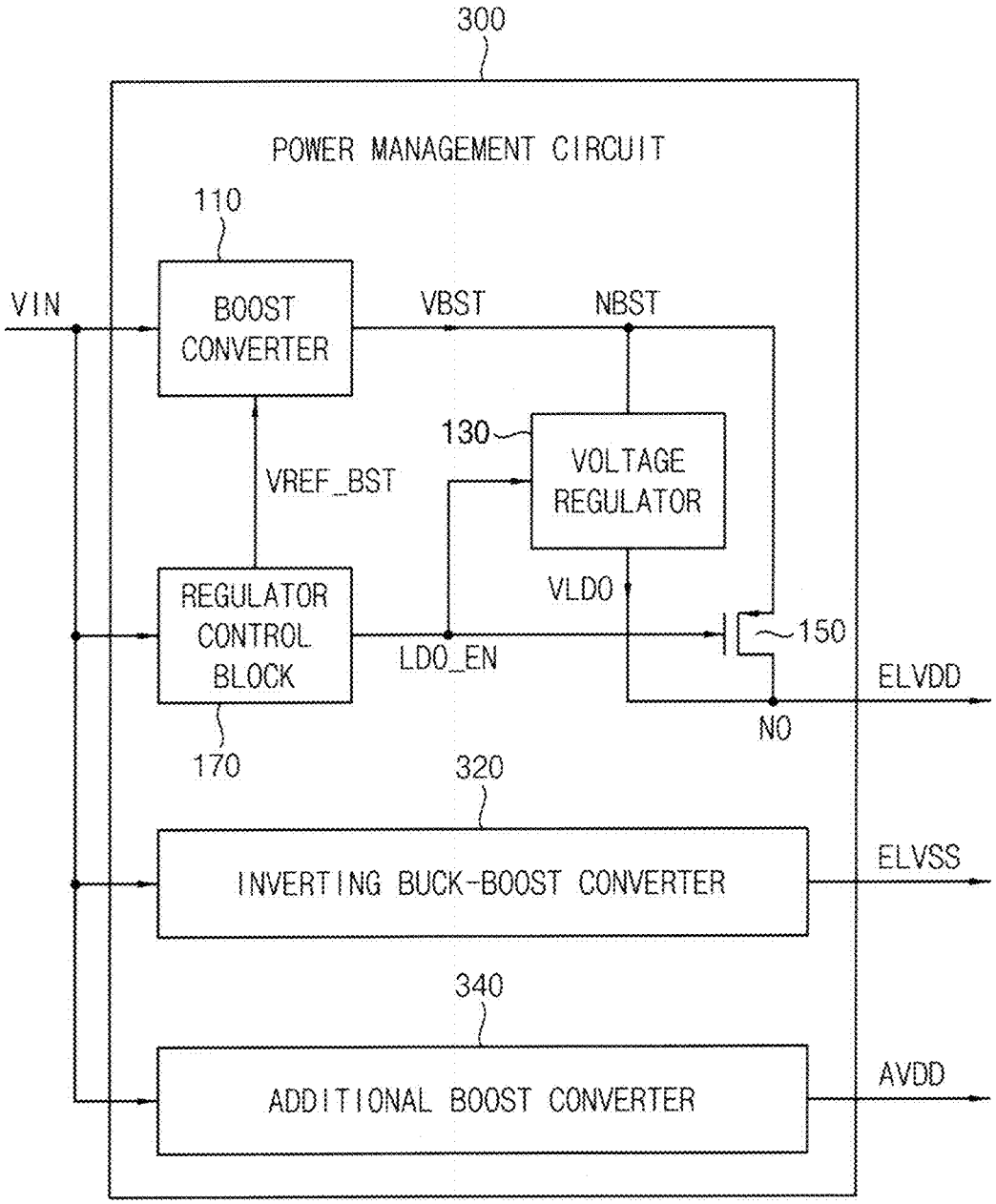
FIG. 7 is a block diagram illustrating a power management circuit according to an alternative embodiment.

FIG. 7 is a block diagram illustrating a power management circuit according to an alternative embodiment.

Referring to FIG. 7, an embodiment of a power management circuit 300 may include a boost converter 110, a voltage regulator 130, a bypass transistor 150, a regulator control block 170, an inverting buck-boost converter 320 and an additional boost converter 340. In such an embodiment, as shown in FIG. 7, the power management circuit 300 may be substantially the same as the embodiments of a power management circuit 100 described above with reference to FIGS. 1 and 2, except that the power management circuit 300 of FIG. 7 further includes the inverting buck-boost converter 320 and the additional boost converter 340.

In an embodiment of the power management circuit 300, the inverting buck-boost converter 320 may convert an input voltage VIN into a negative pixel power supply voltage ELVSS for pixels of a display panel. In one embodiment, for example, the negative pixel power supply voltage ELVSS may be, but not limited to, in a range from about −6.6 V to about −0.8 V.

The additional boost converter 340 may convert the input voltage VIN into an analog power supply voltage AVDD. In an embodiment, the analog power supply voltage AVDD may be provided to a data driver. In one embodiment, for example, the analog power supply voltage AVDD may be, but not limited to, in a range from about 6.8 V to about 7.9 V.

Figure 8:
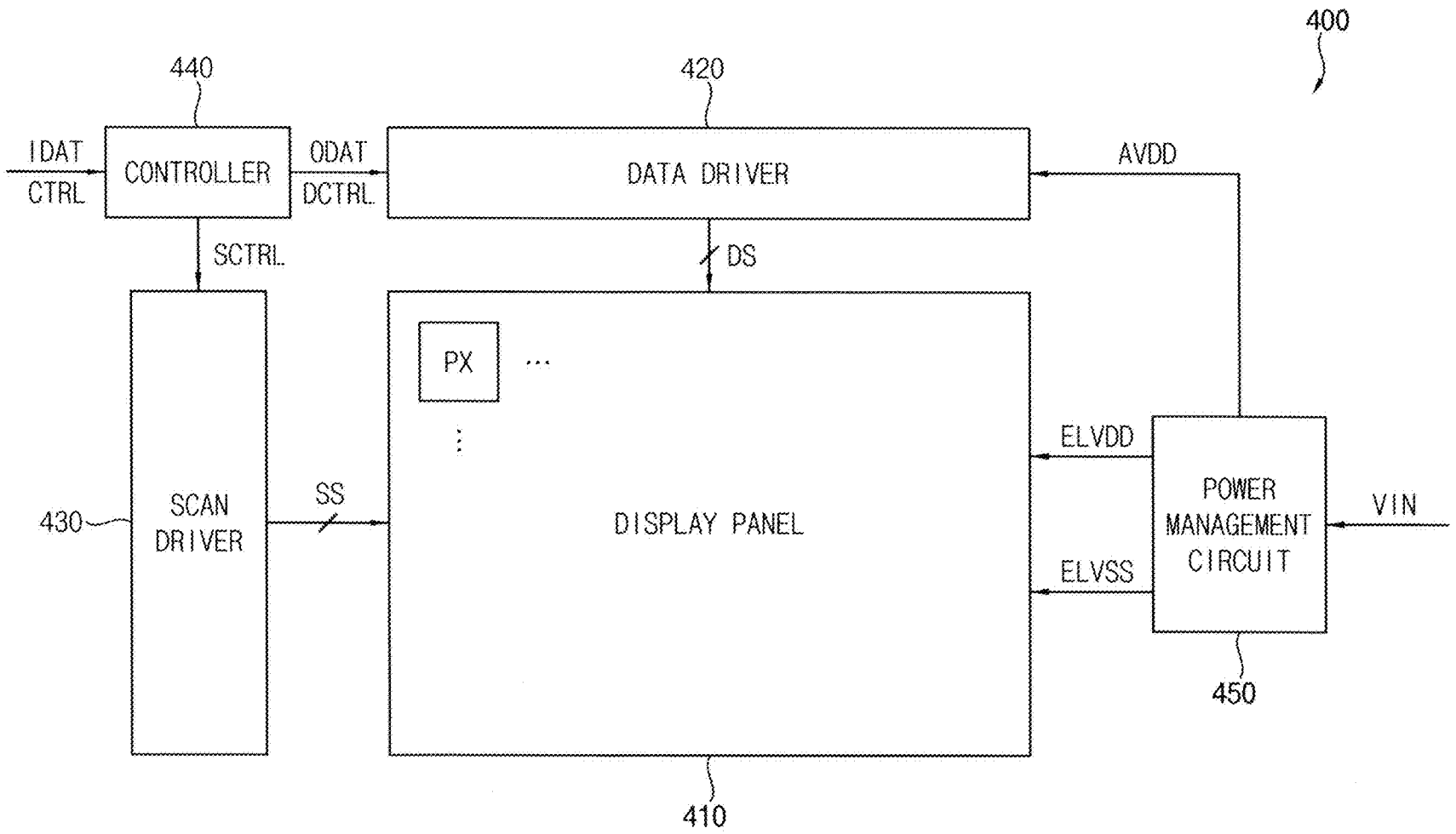
FIG. 8 is a block diagram illustrating a display device including a power management circuit according to an embodiment.

FIG. 8 is a block diagram illustrating a display device including a power management circuit according to an embodiment.

Referring to FIG. 8, an embodiment of a display device 400 may include a display panel 410 including pixels PX, a data driver 420 for providing data signals DS to the pixels PX, a scan driver 430 for providing scan signals SS to the pixels PX, a controller 440 for controlling the data driver 420 and the scan driver 430, and a power management circuit 450 for supplying a pixel power supply voltage ELVDD to the pixels PX.

The display panel 410 may include data lines, scan lines, and the pixels PX coupled to the data lines and the scan lines. In an embodiment, each pixel PX may include at least two transistors, at least one capacitor and an organic light emitting diode OLED, and the display panel 410 may be an OLED display panel. In an alternative embodiment, the display panel 410 may be a liquid crystal display ("LCD") panel, or any other types of display panel.

The data driver 420 may generate the data signal DS based on a data control signal DCTRL and output image data ODAT received from the controller 440, and may provide the data signal DS to the pixels PX through the data lines. In an embodiment, the data control signal DCTRL may include, but not limited to, an output data enable signal, a horizontal start signal and a load signal. In an embodiment, the data driver 420 and the controller 440 may be implemented with a single integrated circuit, and the single integrated circuit may be referred to as a timing controller embedded data driver ("TED"). In an alternative embodiment, the data driver 420 and the controller 440 may be implemented with separate integrated circuits.

The scan driver 430 may generate the scan signals SS based on a scan control signal SCTRL received from the controller 440, and may provide the scan signals SS to the pixels PX on a row-by-row basis through the scan lines. In an embodiment, the scan control signal SCTRL may include, but not limited to, a start signal and a scan clock signal. In an embodiment, the scan driver 430 may be integrated or formed as a single integrated circuit in a peripheral portion of the display panel 410. In an alternative embodiment, the scan driver 430 may be implemented with two or more integrated circuits.

The controller 440 (e.g., a timing controller (also referred to as TCON)) may receive input image data IDAT and a control signal CTRL from an external host processor (e.g., an application processor ("AP"), a graphic processing unit ("GPU") or a graphic card). In an embodiment, the control signal CTRL may include, but not limited to, a vertical synchronization signal, a horizontal synchronization signal, an input data enable signal, a master clock signal, or the like. The controller 440 may generate the data control signal DCTRL, the output image data ODAT and the scan control signal SCTRL based on the control signal CTRL and the input image data IDAT. The controller 440 may control an operation of the data driver 420 by providing the data control signal DCTRL and the output image data ODAT to the data driver 420, and may control an operation of the scan driver 430 by providing the scan control signal SCTRL to the scan driver 430.

The power management circuit 450 may convert an input voltage VIN into a high pixel power supply voltage ELVDD, a low pixel power supply voltage ELVSS and/or an analog power supply voltage AVDD. In an embodiment, the high pixel power supply voltage ELVDD may be a positive pixel power supply voltage ELVDD, and the low pixel power supply voltage ELVSS may be a negative pixel power supply voltage ELVSS. The power management circuit 450 may supply the high pixel power supply voltage ELVDD and the low pixel power supply voltage ELVSS to the pixels PX, and may supply the analog power supply voltage AVDD to the data driver 420. According to an embodiment, the power management circuit 450 may be substantially the same as the embodiment of a power management circuit 100 described above with reference to FIGS. 1 and 2, FIG. 7, or the like. In an embodiment of the power management circuit 450, when the input voltage VIN is higher than or equal to a reference input voltage, a boosted voltage may be increased, a voltage regulator may be enabled to generate a regulated voltage by regulating the increased boosted voltage, the regulated voltage may be output as the high pixel power supply voltage ELVDD, and an enable state of the voltage regulator may be maintained for a minimum enable time. Accordingly, the high pixel power supply voltage ELVDD having a desired voltage level may be generated with respect to a wide range of the input voltages VIN.

Figure 9:
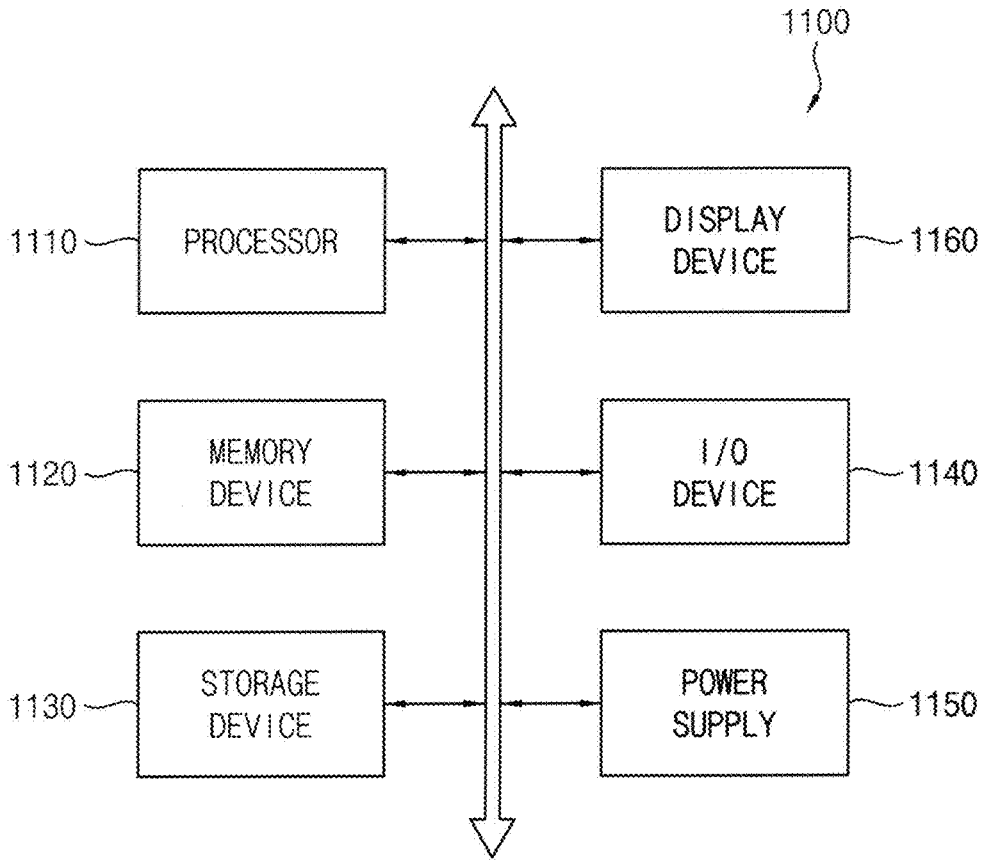
FIG. 9 is a block diagram illustrating an electronic device including a display device according to an embodiment.

FIG. 9 is a block diagram illustrating an electronic device including a display device according to an embodiment.

Referring to FIG. 9, an embodiment of an electronic device 1100 may include a processor 1110, a memory device 1120, a storage device 1130, an input/output ("I/O") device 1140, a power supply 1150, and a display device 1160. The electronic device 1100 may further include a plurality of ports for communicating a video card, a sound card, a memory card, a universal serial bus ("USB") device, other electric devices, etc.

The processor 1110 may perform various computing functions or tasks. The processor 1110 may be an application processor ("AP"), a microprocessor, a central processing unit ("CPU"), etc. The processor 1110 may be coupled to other components via an address bus, a control bus, a data bus, etc. In an embodiment, the processor 1110 may be further coupled to an extended bus such as a peripheral component interconnection ("PCI") bus.

The memory device 1120 may store data for operations of the electronic device 1100. In one embodiment, for example, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile dynamic random access memory (mobile DRAM) device, etc.

The storage device 1130 may be a solid state drive ("SSD") device, a hard disk drive ("HDD") device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

In an embodiment of a power management circuit of the display device 1160, when an input voltage is higher than or equal to a reference input voltage, a boosted voltage may be increased, a voltage regulator may be enabled to generate a regulated voltage by regulating the increased boosted voltage, the regulated voltage may be output as a pixel power supply voltage, and an enable state of the voltage regulator may be maintained for a minimum enable time. Accordingly, in such an embodiment of the power management circuit of the display device 1160, the pixel power supply voltage having a desired voltage level may be generated with respect to a wide range of the input voltages.

The inventions may be applied to any electronic device 1100 including the display device 1160. In one embodiment, for example, the inventions may be applied to a mobile phone, a smart phone, a tablet computer, a virtual reality ("VR") device, a television ("TV"), a digital TV, a three-dimensional ("3D") TV, a wearable electronic device, a personal computer ("PC"), a home appliance, a laptop computer, a personal digital assistant ("PDA"), a portable multimedia player ("PMP"), a digital camera, a music player, a portable game console, a navigation device, etc.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A power management circuit for supplying a pixel power supply voltage to pixels of a display panel, the power management circuit comprising:

a boost converter which generates a boosted voltage at a boosting node by boosting an input voltage by using a reference boosting voltage;

a voltage regulator coupled to the boosting node and an output node;

a bypass transistor coupled between the boosting node and the output node; and a regulator control block which receives the input voltage, outputs the reference boosting voltage, and controls the voltage regulator and the bypass transistor, wherein the regulator control block compares the input voltage with a reference input voltage, and wherein when the input voltage is higher than or equal to the reference input voltage, the regulator control block increases the reference boosting voltage to increase the boosted voltage, enables the voltage regulator to generate a regulated voltage by regulating the increased boosted voltage, turns off the bypass transistor such that the regulated voltage is output as the pixel power supply voltage at the output node, and maintains an enable state of the voltage regulator for a minimum enable time.

2. The power management circuit of claim 1, wherein when the input voltage is lower than the reference input voltage, the regulator control block disables the voltage regulator, and turns on the bypass transistor such that the boosted voltage is output as the pixel power supply voltage at the output node.

3. The power management circuit of claim 1, wherein the regulator control block generates a regulator enable signal having a first voltage level when the input voltage is lower than the reference input voltage, and the regulator control block generates the regulator enable signal having a second voltage level when the input voltage is higher than or equal to the reference input voltage.

4. The power management circuit of claim 3, wherein the voltage regulator is disabled in response to the regulator enable signal having the first voltage level, and the voltage regulator is enabled in response to the regulator enable signal having the second voltage level.

5. The power management circuit of claim 3, wherein the bypass transistor is turned on to connect the boosting node to the output node in response to the regulator enable signal having the first voltage level, and the bypass transistor is turned off to disconnect the boosting node from the output node in response to the regulator enable signal having the second voltage level.

6. The power management circuit of claim 1, wherein the regulator control block includes:

an input voltage sensing block which senses the input voltage, and compares the input voltage with the reference input voltage; and a timing control block which counts a time period from a time point at which the voltage regulator is enabled, and wherein when the input voltage is higher than or equal to the reference input voltage, the regulator control block generates a regulator enable signal having a second voltage level, the regulator control block maintains the regulator enable signal as the second voltage level until the counted time period becomes the minimum enable time, and the regulator control block changes the regulator enable signal from the second voltage level to a first voltage level when the input voltage becomes lower than the reference input voltage after the counted time period becomes the minimum enable time.

7. The power management circuit of claim 6, wherein when the input voltage again becomes higher than or equal to the reference input voltage before the counted time period becomes the minimum enable time, the timing control block resets the counted time period, and again counts the time period.

8. The power management circuit of claim 1, wherein the minimum enable time corresponds to one frame period for the display panel.

9. The power management circuit of claim 1, wherein the minimum enable time is about 16 ms.

10. The power management circuit of claim 1, wherein the voltage regulator is a low-dropout regulator.

11. The power management circuit of claim 1, wherein the voltage regulator includes:

a switch coupled between the boosting node and the output node;

a voltage divider coupled to the output node, and which generate a regulator feedback voltage by dividing the regulated voltage; and an amplifier which controls the switch by comparing the regulator feedback voltage with a reference regulator voltage.

12. The power management circuit of claim 1, wherein the boost converter includes:

an inductor which receives the input voltage;

a capacitor coupled to the boosting node;

a p-type transistor coupled between the inductor and the boosting node;

an n-type transistor coupled between the inductor and a ground voltage;

a boosting voltage divider coupled to the boosting node, and which generates a boosting feedback voltage by dividing the boosted voltage;

an error amplifier which amplifies a difference between the boosting feedback voltage and the reference boosting voltage;

a comparator which compares an output signal of the error amplifier with a ramp voltage; and a switch control block which generates a first switching signal and a second switching signal to control the p-type transistor and the n-type transistor based on an output signal of the comparator.

13. The power management circuit of claim 1, further comprising:

an inverting buck-boost converter which converts the input voltage into a negative pixel power supply voltage for the pixels; and an additional boost converter which converts the input voltage into an analog power supply voltage.

14. A method of generating a pixel power supply voltage to be supplied to pixels of a display panel, the method comprising:

comparing an input voltage with a reference input voltage;

generating a boosted voltage by boosting the input voltage by using a reference boosting voltage when the input voltage is lower than the reference input voltage;

outputting the boosted voltage as the pixel power supply voltage when the input voltage is lower than the reference input voltage;

increasing the reference boosting voltage when the input voltage is higher than or equal to the reference input voltage;

generating an increased boosted voltage by boosting the input voltage by using the increased reference boosting voltage when the input voltage is higher than or equal to the reference input voltage;

generating, at a voltage regulator, a regulated voltage by regulating the increased boosted voltage when the input voltage is higher than or equal to the reference input voltage;

outputting the regulated voltage as the pixel power supply voltage when the input voltage is higher than or equal to the reference input voltage; and maintaining an enable state of the voltage regulator for a minimum enable time when the input voltage is higher than or equal to the reference input voltage.

15. The method of claim 14, wherein the outputting the boosted voltage as the pixel power supply voltage includes:

disabling the voltage regulator; and turning on a bypass transistor coupled between a boosting node and an output node.

16. The method of claim 14, wherein the outputting the regulated voltage as the pixel power supply voltage includes:

enabling the voltage regulator; and turning off a bypass transistor coupled between a boosting node and an output node.

17. The method of claim 14, wherein the maintaining the enable state of the voltage regulator for the minimum enable time includes:

counting a time period from a time point at which the voltage regulator is enabled; and maintaining the enable state of the voltage regulator until the counted time period becomes the minimum enable time.

18. The method of claim 17, further comprising:

disabling the voltage regulator when the input voltage becomes lower than the reference input voltage after the counted time period becomes the minimum enable time.

19. The method of claim 17, further comprising:

resetting the counted time period when the input voltage again becomes higher than or equal to the reference input voltage before the counted time period becomes the minimum enable time.

20. A display device comprising:

a display panel including pixels;

a data driver which provides data signals to the pixels;

a scan driver which provides scan signals to the pixels;

a controller which controls the data driver and the scan driver; and a power management circuit which supplies a pixel power supply voltage to the pixels, wherein the power management circuit comprises:

a boost converter which generates a boosted voltage at a boosting node by boosting an input voltage by using a reference boosting voltage;

a voltage regulator coupled to the boosting node and an output node;

a bypass transistor coupled between the boosting node and the output node; and a regulator control block which receives the input voltage, outputs the reference boosting voltage, and controls the voltage regulator and the bypass transistor, wherein the regulator control block compares the input voltage with a reference input voltage, and wherein when the input voltage is higher than or equal to the reference input voltage, the regulator control block increases the reference boosting voltage to increase the boosted voltage, enables the voltage regulator to generate a regulated voltage by regulating the increased boosted voltage, turns off the bypass transistor such that the regulated voltage is output as the pixel power supply voltage at the output node, and maintains an enable state of the voltage regulator for a minimum enable time.

* * * * *